US009864301B1

(12) United States Patent
Ogasahara

(10) Patent No.: US 9,864,301 B1
(45) Date of Patent: Jan. 9, 2018

(54) IMAGE FORMING APPARATUS

(71) Applicant: KYOCERA Document Solutions Inc., Osaka (JP)

(72) Inventor: Okito Ogasahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/595,029

(22) Filed: May 15, 2017

(30) Foreign Application Priority Data

Jul. 6, 2016 (JP) ..... 2016-134201

(51) Int. Cl.
*G03G 15/08* (2006.01)
*G03G 21/18* (2006.01)

(52) U.S. Cl.
CPC ..... *G03G 15/0877* (2013.01); *G03G 15/0824* (2013.01); *G03G 21/1814* (2013.01)

(58) Field of Classification Search
CPC ..... G03G 15/0877; G03G 21/1814; G03G 15/0824
See application file for complete search history.

(56) References Cited

U.S. PATENT DOCUMENTS 6,704,521 B2 * 3/2004 Isobe ..... G03G 15/553 399/12
2003/0035656 A1 * 2/2003 Yamamoto ..... G03G 21/1889 399/27
2009/0214233 A1 * 8/2009 Murauchi ..... G03G 15/0877 399/30
2009/0310984 A1 * 12/2009 Sakatani ..... G03G 15/0856 399/30
2013/0236201 A1 * 9/2013 Mizutani ..... G03G 15/1675 399/53
2014/0255047 A1 * 9/2014 Hirobe ..... G03G 15/0824 399/27
2016/0041504 A1 * 2/2016 Ueda ..... G03G 15/095 399/359

FOREIGN PATENT DOCUMENTS

JP H05-323790 A 12/1993

* cited by examiner

*Primary Examiner* — Francis Gray
(74) *Attorney, Agent, or Firm* — Studebaker & Brackett PC

(57) ABSTRACT

An image forming apparatus includes a developer container, a development device, a developer replenishment device and a control part. The control part obtains a replenishment amount (X) of the developer replenished by the developer replenishment device from a last-time replenishment until a this-time replenishment and a predicted consumption (Y) of the developer, calculated based on the image data output from the last-time replenishment until the this-time replenishment, and informs abnormality when an absolute value of a difference of the replenishment amount (X) and the predicted consumption (Y) is larger than a threshold value.

6 Claims, 8 Drawing Sheets

IMAGE FORMING APPARATUS

INCORPORATION BY REFERENCE

This application is based on and claims the benefit of priority from Japanese Patent application No. 2016-134201 filed on Jul. 6, 2016, which is incorporated by reference in its entirety.

BACKGROUND

The present disclosure relates to an image forming apparatus which forms an image on a sheet.

In an electrophotographic type image forming apparatus, when an abnormality such as a decreasing in density of a formed image and a scattering of a toner, is detected, countermeasures corresponding to the abnormality are taken. For example, a refresh operation in which a developer carried on a developer carrier is once discharged is carried out. Alternatively, a requirement for cleaning work by a service man is informed. Conventionally, such an abnormality is detected by an optical sensor detecting a scattered toner or a density of a formed image. For accurate detection, it is required to provide the optical sensor at a plurality of positions or to clean the optical sensor itself. This causes increasing in cost. Accordingly, it is desirable to detect such an abnormality without using the optical sensor as much as possible.

On the other hand, there is an image forming apparatus configured such that a toner consumption is calculated using an increasing degree of density of a toner image on an image carrier for a difference between a toner replenishment amount and a toner replenishment amount and then a toner replenishment amount is adjusted based on the calculated toner consumption.

In the image forming apparatus, the density of the toner imager on the image carrier is detected by a reflection type optical sensor. In this case, because a transferring rate of the toner to the image carrier is not 100% and the toner is overlapped on the image carrier, the toner consumption cannot be accurately detected using the density detected by the reflection type image sensor. In addition, if the image carrier such an intermediate transferring belt is damaged, an accurate density cannot be detected.

SUMMARY

In accordance with an aspect of the present disclosure, an image forming apparatus includes a developer container, a development device, a developer replenishment device and control part. The developer container is configured to contain a developer. The development device is configured to develop an electrostatic latent image into a toner image using the developer. The electrostatic latent image is formed on an image carrier based on image data. The developer replenishment device is configured to replenish the developer from the developer container to the development device. The control part is configured to obtain a replenishment amount (X) of the developer replenished by the developer replenishment device from a last-time replenishment until a this-time replenishment and a predicted consumption (Y) of the developer, calculated based on the image data output from the last-time replenishment until the this-time replenishment, and to inform abnormality when an absolute value ($|X-Y|$) of a difference ($X-Y$) of the replenishment amount (X) and the predicted consumption (Y) is larger than a threshold value.

In accordance with another aspect of the present disclosure, an image forming apparatus includes a developer container, a development device, a developer replenishment device, a transferring device, a collecting device and a control part. The developer container is configured to contain a developer. The development device is configured to develop an electrostatic latent image into a toner image using the developer. The electrostatic latent image is formed on an image carrier based on image data. The developer replenishment device is configured to replenish the developer from the developer container to the development device. The transferring device is configured to transfer the toner image developed by the development device to a medium. The collecting device is configured to collect the developer remained on the image carrier after the toner image is transferred to the medium by the transferring device. The control part is configured to obtain a replenishment amount (X) of the developer replenished by the developer replenishment device from a last-time replenishment until a this-time replenishment, a predicted consumption (Y) of the developer, calculated based on the image data output from the last-time replenishment until the this-time replenishment and a collected amount (Z) of the developer collected by the collecting device from the last-time replenishment until the this-time replenishment, and to inform abnormality when an absolute value ($|X-(Y+Z)|$) of a difference ($X-(Y+Z)$) of the replenishment amount (X) and a sum ($Y+Z$) of the predicted consumption (Y) and the collected amount (Z) is equal to or larger than a threshold value.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus according to an embodiment of the present disclosure will be described.

Figure 1:
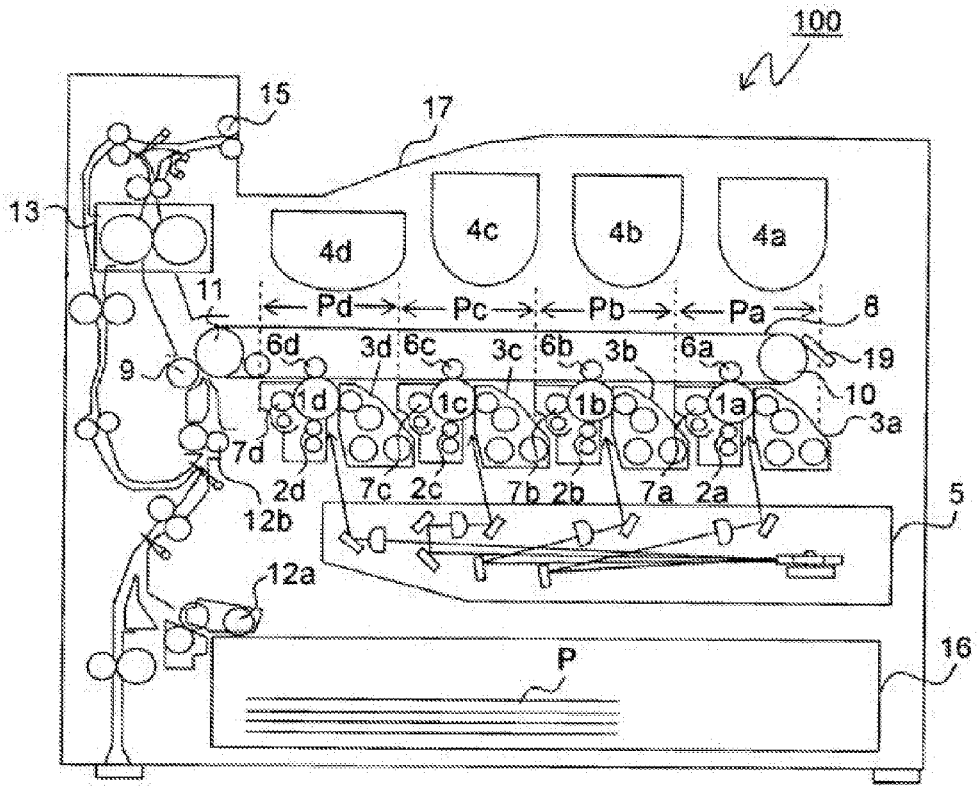
FIG. 1 is a view schematically showing an image forming apparatus according to an embodiment of the present disclosure.

With reference to FIG. 1, the image forming apparatus according to an embodiment of the present disclosure will be described. FIG. 1 is a sectional view showing a structure of the image forming apparatus. The image forming apparatus 100 is a quadruple tandem type color printer including four image forming parts Pa, Pb, Pc and Pd which are adjacently arranged and forma full color image. The four image forming parts Pa, Pb, Pc and Pd respectively correspond to four different colors (magenta, cyan, yellow and black). In the following description, a near side of a paper plan of FIG. 1 shows a front side of the image forming apparatus 1, and left and right directions are based on a direction in which the image forming apparatus is seen from the front side.

In an apparatus main body of the image forming apparatus 100, the four image forming parts Pa to Pd are adjacently arranged in the order from the right side of FIG. 1. These image forming parts Pa to Pd respectively form images of magenta, cyan, yellow and black.

In these image forming parts Pa to Pd, photosensitive drums 1*a*, 1*b*, 1*c* and 1*d* are respectively provided so as to be rotatable in the counterclockwise direction in FIG. 1. The photosensitive drums 1*a* to 1*d* are examples of image carries each of which carries a visible image (a toner image) of each color. Above the photosensitive drums 1*a* to 1*d*, an intermediate transferring belt 8 is supported between a driven roller 10 and a driving roller 11 so as to circulate. The intermediate transferring belt 8 is an example of an image carrier which carries a visible image (a toner image) formed by overlapping the visible image of each color and a medium to which the toner image is transferred. In an inner hollow space of the intermediate transferring belt 8, first transferring rollers 6*a*, 6*b*, 6*c* and 6*d* are rotatably supported so as to oppose to the photosensitive drums 1*a* to 1*d* via the intermediate transferring belt 8. The first transferring rollers 6*a*, 6*b*, 6*c* and 6*d* are examples of transferring device which transfer the toner images from the photosensitive drums 1*a* to 1*d* to the intermediate transferring belt 8. At the left side of the driving roller 11, a secondary transferring roller 9 is rotatably supported so as to oppose to the driving roller 11 via the intermediate transferring belt 8. The second transferring roller 9 is an example of a transferring device which transfers the toner image from the intermediate transferring belt 8 to a sheet. The sheet is an example of a medium on which the toner image is transferred.

On a downstream side of the secondary transferring roller 9 in a rotation direction of the intermediate transferring belt 8 (near the driven roller 10 in this embodiment), a belt cleaning device 19 is disposed. The belt cleaning device 19 removes the toner and the others remained on a surface of the intermediate transferring belt 8. The belt cleaning device 19 is an example of a collection device which collects the toner remained on the intermediate transferring belt 8 after the toner image is transferred to the sheet. The belt cleaning device 19 has a blade and a collection part. The blade comes into contact with the intermediate transferring belt 8 from a counter direction to the rotation direction of the intermediate transferring belt 8. The toner removed by the blade is collected in the collection part. The toner collected in the collection part is conveyed toward the front side of the image forming apparatus 100 by a collection spiral. On a front face of the collection part, a discharge port through which the conveyed toner is discharged is formed.

The sheet P on which the toner image is to be transferred is stored in a sheet feeding cassette 16 provided in a lower portion of the apparatus main body. The sheet P is conveyed to the secondary transferring roller 9 via a feed roller 12*a* and a registration roller pair 12*b*.

Next, the image forming parts Pa to Pd will be described. In the image forming parts Pa to Pd, charging devices 2*a*, 2*b*, 2*c* and 2*d*, developing devices 3*a*, 3*b*, 3*c* and 3*d* and drum cleaning devices 7*a*, 7*b*, 7*c* and 7*d* are respectively disposed around the photosensitive drums 1*a* to 1*d*. The charging devices 2*a* to 2*d* charge the photosensitive drums 1*a* to 1*d* respectively. The developing devices 3*a* to 3*d* develop electrostatic latent images formed on the photosensitive drums 1*a* to 1*d* with the toner respectively. The drum cleaning devices 7*a* to 7*d* remove and collect the developer (the toner) remained on the photosensitive drums 1*a* to 1*d* respectively after the toner images are transferred. Below the image forming parts Pa to Pd, an exposing unit 5 is disposed. The exposing unit 5 performs exposing to the photosensitive drums 1*a* to 1*d* according to an image data.

Next, an image forming operation will be described. When the image data is input from an image input device such as a personal computer, the charging devices 2*a* to 2*d* respectively charge the surfaces of the photosensitive drums 1*a* to 1*d* uniformly, and then the exposing unit 5 performs the exposing to the photosensitive drums 1*a* to 1*d* according to the input image data to form electrostatic latent images corresponding to the input image data on the photosensitive drums 1*a* to 1*d*. The electrostatic latent images are developed by the developing devices 3*a* to 3*d* into toner images of corresponding colors. Then, by applying a predetermined transferring voltage between the first transferring rollers 6*a* to 6*d* and the photosensitive drums 1*a* to 1*d*, the toner images of magenta, cyan, yellow and black colors are first-transferred on the intermediate transferring belt 8. After that, in order to prepare for formation of next new electrostatic latent images on the photosensitive drums 1*a* to 1*d*, the toner remained on the surfaces of the photosensitive drums 1*a* to 1*d* are removed by the drum cleaning devices 7*a* to 7*d* respectively. If a ratio of the toner to the two component developer filled in each of the developing devices 3*a* to 3*d* is lower than a predetermined value by the image forming operation described later, the toner is supplied to the developing devices 3*a* to 3*d* from toner containers 4*a* to 4*d* as developer containers respectively.

The toner images formed on the photosensitive drums 1*a* to 1*d* are sequentially transferred on the intermediate transferring belt 8 and then a full color toner image is secondary-transferred on the sheet P by the secondary transferring roller 9. The full color toner image is heated and pressed at a fixing device 13 to be fixed on the sheet P. The sheet P on which the full color toner image has been fixed is ejected by an ejection roller pair 15 on the ejection tray 7.

Figure 2:
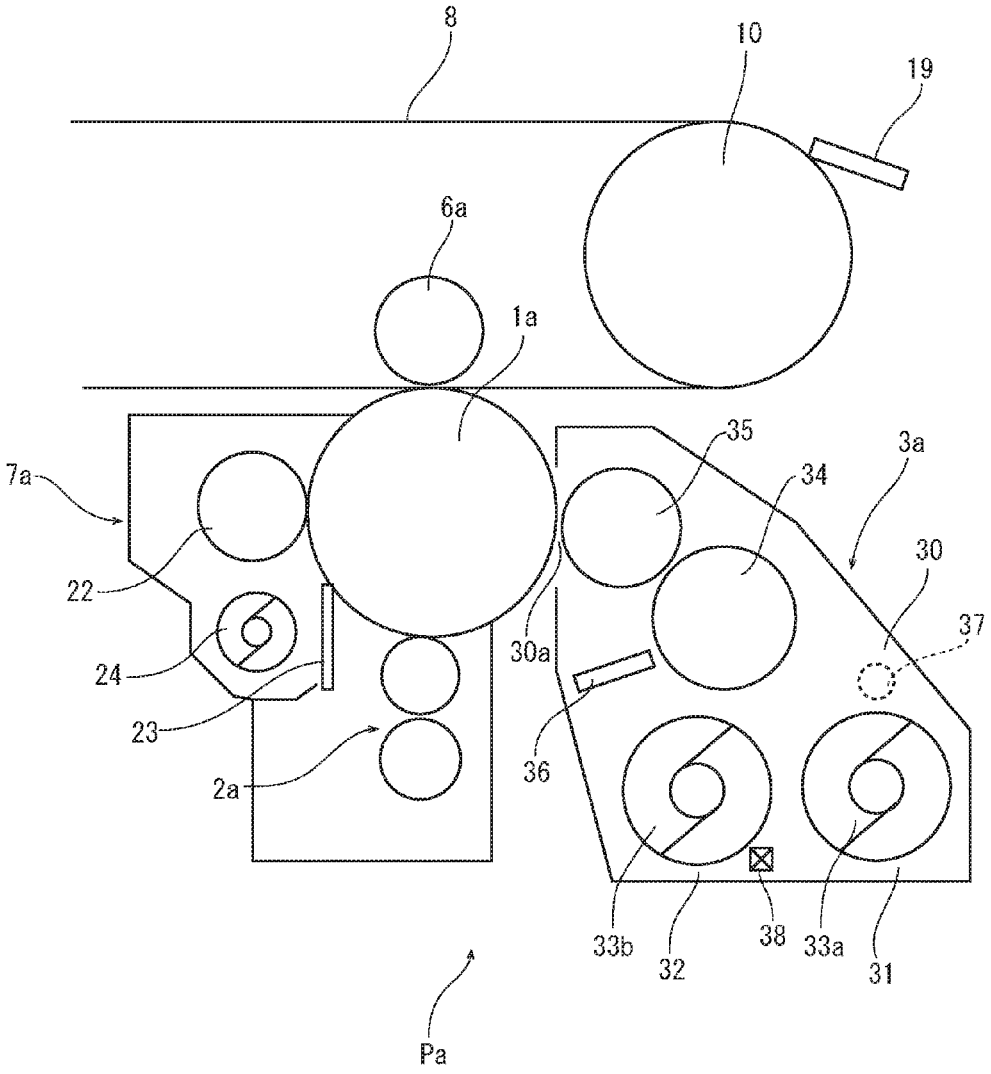
FIG. 2 is a side view showing an image forming part in the image forming apparatus according to the embodiment of the present disclosure.

Next, with reference to FIG. 2, the image forming part Pa described above will be described in detail. FIG. 2 is a partial view showing the image forming part. The image forming parts Pb to Pd each have the substantially same structure as the image forming part Pa, and their detail descriptions are omitted. Around the photosensitive drum 1*a*, the charging device 2*a*, the developing device 3*a*, the first transferring roller 6*a* and the cleaning device 7*a* described above are arranged along the rotation direction of the photosensitive drum 1*a* (the counterclockwise direction in FIG. 2).

The charging device 2*a* has a charging roller 20 and a charging cleaning roller 21. The charging roller 20 comes in contact with the surface of the photosensitive drum 1*a* and applies a charging voltage on the photosensitive drum 1*a*. The charging cleaning roller 21 cleans the charging roller 20.

The developing device 3*a* has a developer container 30 in which the two component developer containing a magnetic carrier and a toner is contained. In a lower portion of the developer container 30, an agitating/conveying chamber 31 and a supplying/conveying chamber 32 are formed. The agitating/conveying chamber 31 has a toner replenishment port 37 through which the toner replenished from the toner container 4*a* by a toner replenishment device 40 (a developer replenishment device, refer to FIG. 3) is received. In the agitating/conveying chamber 31 and the supplying/conveying chamber 32, an agitating/conveying screw 33*a* and a supplying/conveying screw 33*b* are rotatably disposed respectively. The agitating/conveying screw 33*a* and the supplying/conveying screw 33*b* mix the toner replenished with the magnetic carrier, agitate them and charge the toner. The developer container 30 is provided with a toner concentration sensor 38 which detects an amount of the toner contained in the developer container 30. When the toner concentration sensor 38 detects that an amount of the toner in the developer container 30 is smaller than a predetermined value, the toner replenishment device 40 described later replenishes the toner from the toner container 4*a* to the developer container 30. As the toner concentration sensor 38, a magnetic permeability sensor may be used.

The developer container 30 has an opening 30*a* formed at a portion opposing to the photosensitive drum 1*a*. In the developer container 30, a magnetic roller 34 and a development roller 35 are disposed. The magnetic roller 34 is positioned above the supplying/conveying screw 33*b* so as to opposite to the supplying/conveying screw 33*b*. The development roller 35 is positioned at the left upper oblique side of the magnetic roller 34 so as to opposite to the magnetic roller 34. Apart of an outer circumferential face of the development roller 35 is exposed through the opening 30*a* and opposes to the photosensitive drum 1*a*. The magnetic roller 34 and the development roller 35 are rotated in the clockwise direction in FIG. 2.

On an upstream side of the opposing area R of the development roller 35 and the magnetic roller 34 in a rotation direction of the magnetic roller 34, a regulating blade 36 is attached along a length direction of the magnetic roller 34 (a perpendicular direction to the paper plan of FIG. 2). Between a tip edge of the regulating blade 36 and an outer circumferential face of the magnetic roller 34, a small gap is formed.

The developer is agitated while circulating between the agitating/conveying chamber 31 and the supplying/conveying chamber 32 in the developer container 30 by the agitating/conveying screw 33*a* and the supplying/conveying screw 33*b*. This charges the toner. The developer containing the charged toner is conveyed to the magnetic roller 34 by the supplying/conveying screw 33*b* to form a magnetic brush around the magnetic roller 34. A thickness of the magnetic brush is regulated by the regulating blade 36. The magnetic brush of which the thickness has been regulated is conveyed to the opposing area R of the magnetic roller 34 and the development roller 35. At the opposing area R, the magnetic brush forms a toner layer on the development roller 35 by voltage difference between a DC voltage applied to the magnetic roller 34 and a DC voltage applied to the development roller 35 and magnetic field generated by the magnetic roller 34.

The toner layer formed on the development roller 35 is conveyed by the rotation of the development roller 35 to the opposing area where the photosensitive drum 1*a* and the development roller 35 are opposite to each other. Because the predetermined voltage is applied to the development roller 35, the toner fries from the development roller 35 to the photosensitive drum 1*a* owing to voltage difference between the development roller 35 and the photosensitive drum 1*a*, and develops the electrostatic latent image on the photosensitive drum 1*a*.

The drum cleaning device 7*a* has a rubbing roller 22, a cleaning blade 23 and a collection spiral 24. The drum cleaning device 7*a* is an example of a collection device which collects the toner remained on the photosensitive drum 1 after the toner image is transferred to the intermediate transferring belt 8.

The rubbing roller 22 comes into pressure contact with the photosensitive drum 1*a* at a predetermined pressure. The cleaning blade 23 is supported on a downstream side of the contact portion of the rubbing roller 22 and the photosensitive drum 1*a* in the rotation direction of the photosensitive drum 1*a*, and comes in contact with the photosensitive drum 1*a* from a counter direction to the rotation direction of the photosensitive drum 1*a*. The collection spiral 24 conveys the toner removed from the surface of the photosensitive drum 1*a* by the rubbing roller 22 and the cleaning blade 23 to the front side of the image forming apparatus 100. On a front face of the drum cleaning device 7*a*, a discharge port through which the conveyed toner is discharged is formed.

Figure 3:
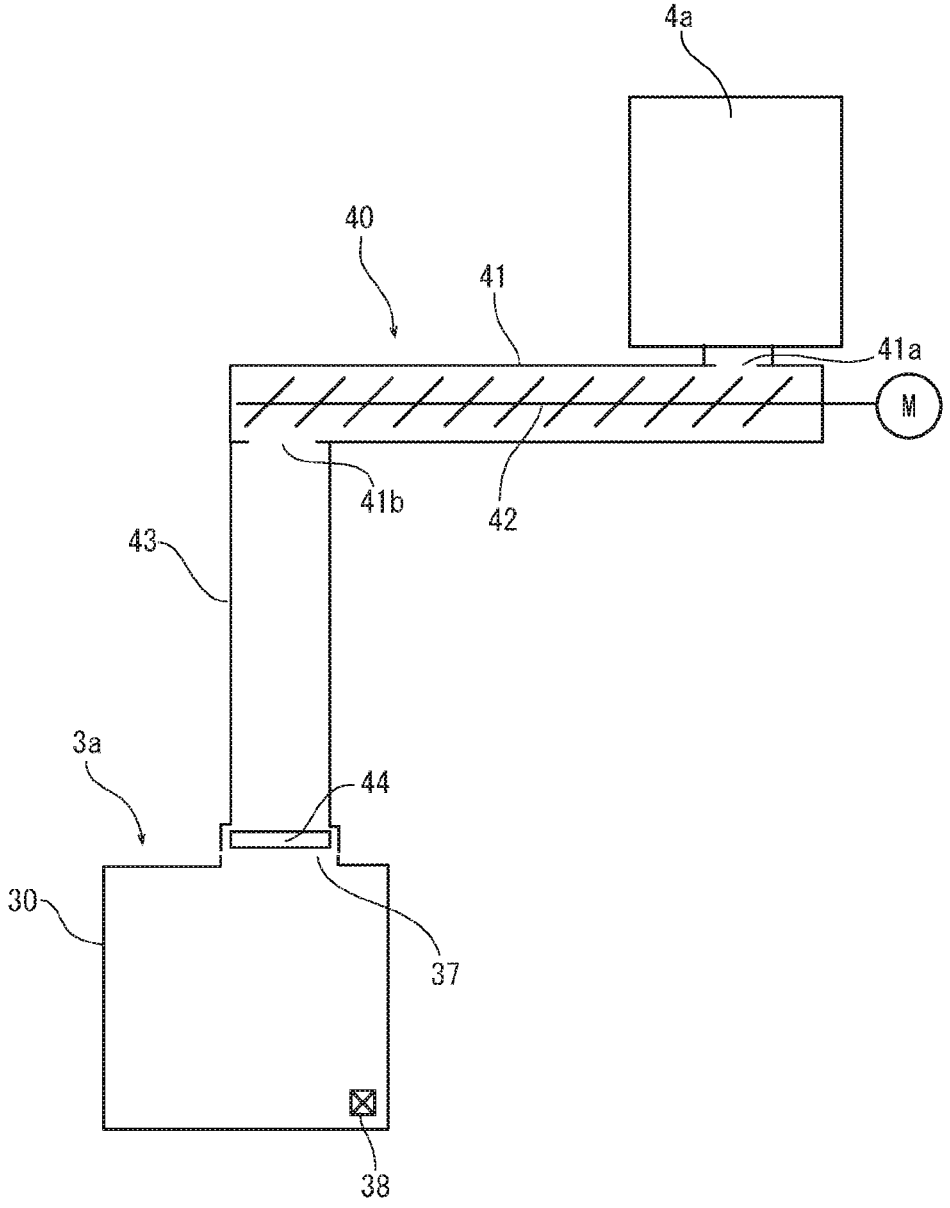
FIG. 3 is a side view showing a toner replenishment path in the image forming apparatus according to the embodiment of the present disclosure.

Next, with reference to FIG. 3, the toner replenishment device 40 will be described. The toner replenishment device 40 replenishes the toner from the toner container 4*a* to the developer container 30 of the development device 3*a*. FIG. 3 is a view schematically showing a toner replenishment path.

As shown in FIG. 3, the toner replenishment device 40 includes a toner conveying duct 41, a conveying screw 42, a toner replenishment duct 43 and a shutter member 44. The toner conveying duct 4*l* extends horizontally from a lower portion of the toner container 4*a*. The conveying screw 42 is disposed in the toner conveying duct 41. The toner replenishment duct 43 is communicated with the toner conveying duct 41 and extend in the vertical direction to communicate with the toner replenishment port 37 of the development device 3*a*. The shutter member 44 is slidable horizontally to open and close the toner replenishment port 37 of the development device 3*a*.

On one end of the toner conveying duct 41, a toner receiving port 40*a* is formed. The toner receiving port 40*a* is communicated with the toner container 4*a*. On the other end of the toner conveying duct 41, a toner discharge port 40*b* is formed. The toner discharge port 40*b* is communicated with the toner replenishment duct 43.

The toner conveying screw 42 is disposed in the toner conveying duct 41 so as to be rotatable. To an end of the toner conveying screw 42, a replenishment motor M is coupled. When the replenishment motor M is driven, the conveying screw 42 is rotated to convey the toner received into the toner conveying duct 41 through the toner receiving port 40*a* toward the toner discharge port 40*b*.

As the replenishment motor M, a stepping motor capable of managing a rotation speed or a blushless motor may be desirable. However, when the blushless motor is used, it is required to detect the rotation speed of the conveying screw 42 by an optical sensor and an encoder.

The toner replenishment duct 43 extends downward in the vertical direction from the toner discharge port 40*b* of the toner conveying duct 41 and is communicated with the toner replenishment port 37 of the developer container 30.

The shutter member 44 is horizontally slid between an opening position where a lower end opening of the toner replenishment duct 43 is opened and a closing position where the opening is closed. In a state where the development device 3*a* is not attached, the shutter member 44 is biased into the closing position by a spring member. When the development device 3*a* is attached, the shutter member 44 is pressed by the development device 3*a* to be slid into the opening position against biasing force of the spring member. Thereby, the opening of the toner replenishment duct 43 is communicated with the toner replenishment port 37 of the developer container 30.

When the toner concentration sensor 38 of the developer container 30 of the development device 3*a* detects that an amount of the toner in the developer container 30 is smaller than the predetermined value, the conveying screw 42 is rotated to convey the toner supplied from the toner container 4*a* toward the toner discharge port 40*b* in the toner conveying duct 41. Then, the toner is replenished to the developer container 30 from the toner replenishment port 37 through the toner replenishment duct 43.

The image forming apparatus 100 includes a toner collection device 50. The toner collection device 50 collects the toner collected by the drum cleaning devices 7*a* to 7*d* and the belt cleaning device 19.

Figure 4:
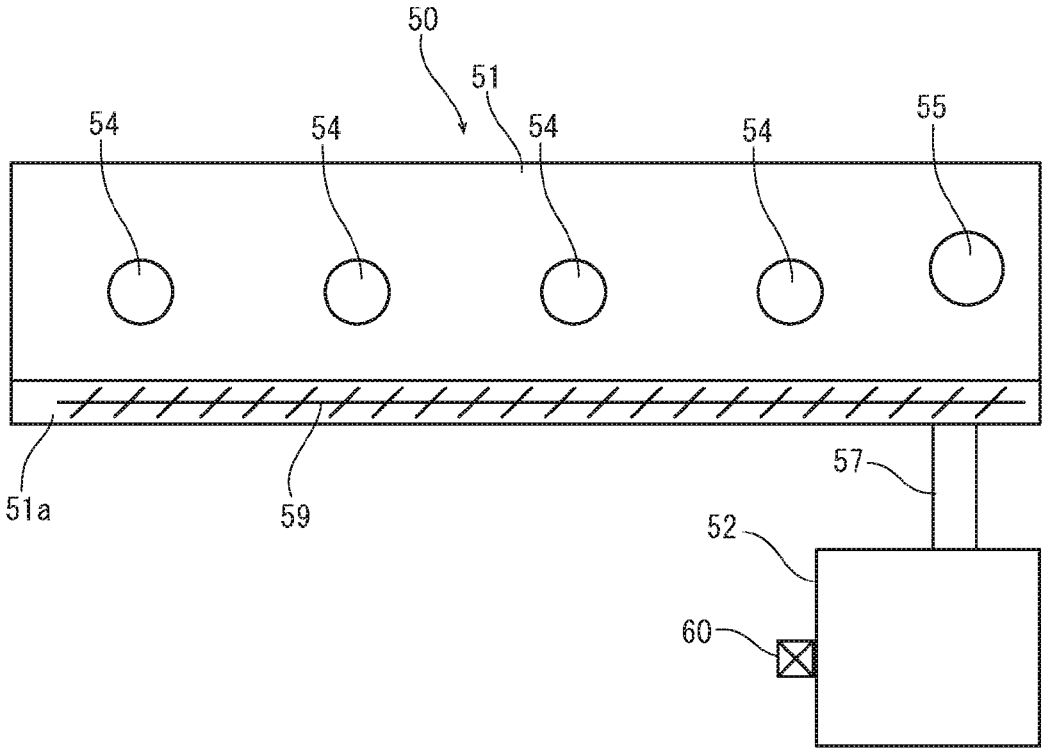
FIG. 4 is a side view showing a toner collection device in the image forming apparatus according to an embodiment of the present disclosure.

Next, with reference to FIG. 4, the toner collection device 50 will be described. FIG. 4 is a perspective front view showing the toner collection device 50.

The toner collection device 50 includes an intermediate collection box 51 and a toner collection container 52. The intermediate collection box 51 is disposed at the front side of the image forming parts Pa to Pd and stores the collected toner temporarily. The toner collection container 52 is disposed under the intermediate collection box 51 and collects the toner finally.

The intermediate collection box 51 has a hollow space having a size corresponding to the four image forming parts Pa to Pd. The intermediate collection box 51 has collected toner receiving ports 54 and a collected toner receiving port 55. The collected toner receiving ports 54 are communicated with the discharge ports of the drum cleaning devices 7*a* to 7*d*. The collected toner receiving port 55 is communicated with the toner discharge port of the belt cleaning device 19. On a bottom portion of the intermediate collection box 51, a conveying path 51*a* is formed along in the left and right directions. The toner received from the collected toner receiving ports 54 and 55 is fallen on the conveying path 51*a* by its own weight. On one end of a bottom portion of the conveying path 51*a*, a connection pipe 57 which is communicated with the toner collection container 52 is connected.

In the conveying path 51*a*, a conveying screw 59 is rotatably supported. The conveying screw 59 conveys the fallen toner on the conveying path 51*a* toward the connection pipe 57. The conveyed toner is collected in the toner collection container 52 through the connection pipe 57. The toner collection container 52 is provided with a weight sensor 60.

The image forming apparatus 100 includes a control part 70 which controls operation of each of the image forming parts Pa to Pd, the toner replenishment device 40, the toner collection device 50 and the others.

Figure 5:
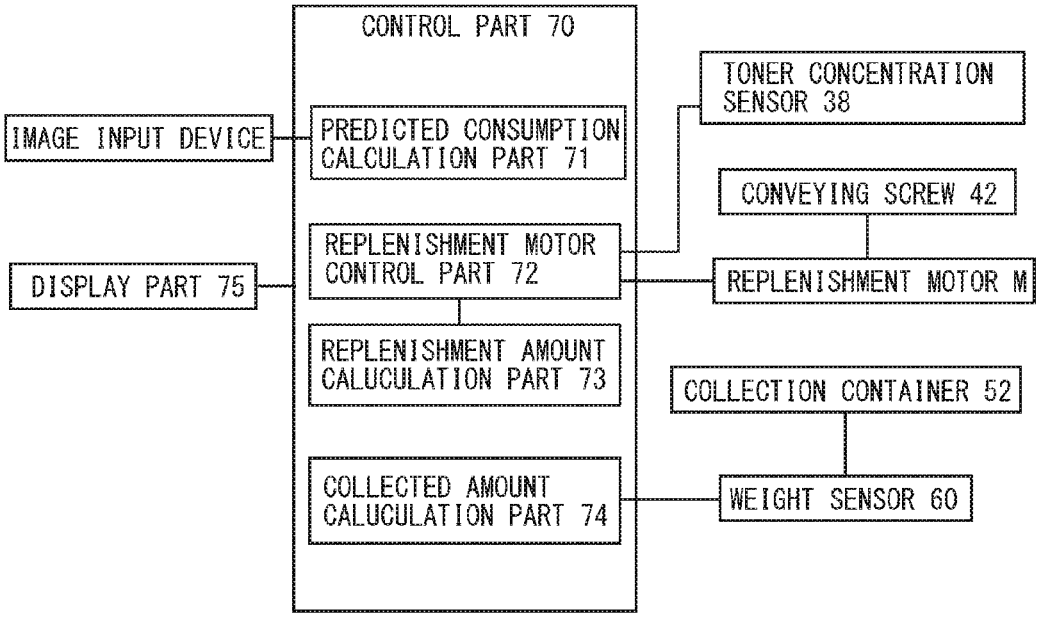
FIG. 5 is a block diagram showing a control part in the image forming apparatus according to the embodiment of the present disclosure.

With reference to FIG. 5, the control part 70 will be described. FIG. 5 is a block diagram showing the control part. The control part 70 is constructed by a CPU, a ROM storing a control program, a RAM used as a working region and the others.

The control part 70 has a predicted consumption calculation part 71, a replenishment motor control part 72, a replenishment amount calculation part 73, a collected amount calculation part 74 and a display part 75.

The predicted consumption calculation part 71 calculates an amount (a predicted consumption Y) of the toner to be consumed, based on the image data input from the image input device. For example, pixels constituting the image data are divided into an image part and a non-image part, and the amount of the toner to be consumed is calculated based on a number of the pixels constituting the image part.

To the replenishment motor control part 72, an output value output from the toner concentration sensor 38 of the developer container 30 is input. Based on the input toner concentration, the replenishment motor control part 72 controls the rotation speed of the replenishment motor M which rotates the conveying screw 42 of the toner replenishment device 40.

The replenishment amount calculation part 73 calculates the rotation speed of the replenishment motor M, in which the rotation speed is controlled by the replenishment motor control part 72. Then, the replenishment amount calculation part 73 calculates the rotation speed of the conveying screw 42 based on the rotation speed of the replenishment motor M, and then an amount (a replenishment amount X) of the toner replenished to each of the development devices 3*a* to 3*d* from the corresponding toner containers 4*a* to 4*d* is calculated based on the calculated rotation speed of the conveying screw 42.

To the collected amount calculation part 74, an output value output from the weight sensor 60 of the toner collection container 52 is input. The collected amount calculation part 74 calculates an amount (a collected amount Z) of the toner collected in the toner collection container 52 by the drum cleaning devices 7*a* to 7*d* and the belt cleaning device 19.

The display part 75 is a liquid crystal panel provided on the image forming apparatus 100 or a remote communication terminal owned by a service man, for example.

Figure 6:
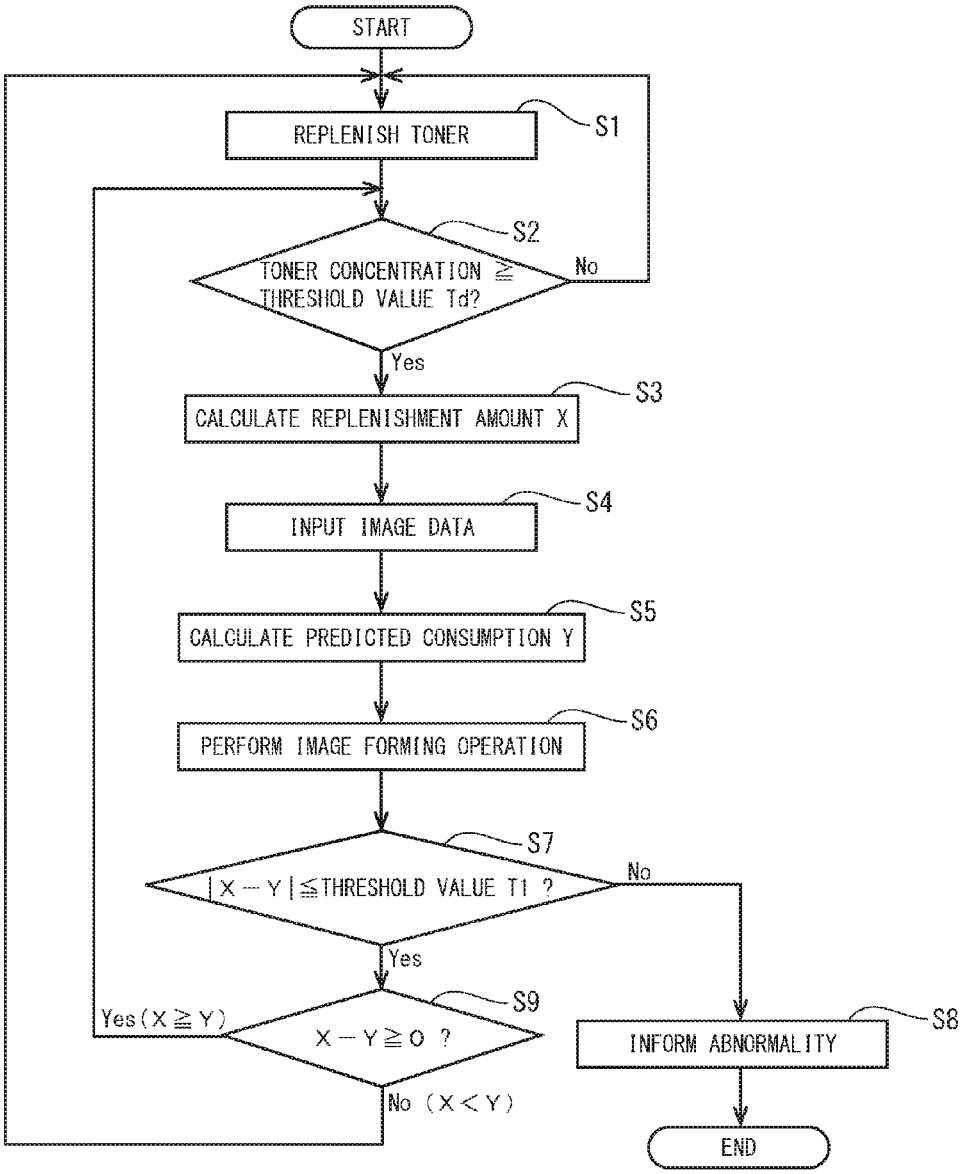
FIG. 6 is a flowchart explaining an abnormality detecting process of a first embodiment, in the image forming apparatus according to the embodiment of the present disclosure.

An abnormality detecting process of a first embodiment in the image forming apparatus 100 having the above described configuration will be described with reference to a flowchart showing in FIG. 6. In the abnormality detecting process, by comparing the replenishment amount (X) of the toner replenished by one toner replenishment performed by the toner replenishment device 40 with the predicted consumption (Y) of the toner to be consumed by the image forming operation performed after the toner replenishment, it is decided whether the replenished toner is adequately consumed for the image forming operation or not is decided.

First, at step S1, the replenishment motor control part 72 controls the replenishment motor M of the toner replenishment device 40 to rotate the conveying screw 59 at a predetermined rotation speed. Thereby, the toner is replenished to the developer container 30 from the toner container 4*a*.

Next, at step S2, the replenishment motor control part 72 decides whether a toner concentration detected by the toner concentration sensor 38 of the developer container 30 is equal to or larger than a predetermined concentration Td or not.

As a result, when it is decided that the detected toner concentration is equal to or larger than the predetermined concentration Td, the process proceeds to step S3. At step S3, the replenishment amount calculation part 73 calculates an amount X (a replenishment amount) of the replenished toner from the rotation speed of the conveying screw 59 in the toner replenishment. When it is decided that the detected toner concentration is smaller than the predetermined concentration Td, the process returns to step S1 and the toner replenishment is repeated until the detected toner concentration is equal to or larger than the predetermined toner concentration Td.

Next, when the image data is input from the image input device at step S4, the predicted consumption calculation part 71 calculates a predicted consumption Y based on the input image data. The predicted consumption Y calculated at step S5 is obtained by adding a predicted consumption Y calculated from the image data input at this time to a predicted consumption Y calculated from the image data input at last time. That is, the predicted consumption Y calculated at step S5 is obtained by accumulating the predicted consumption Y predicted from the image data input after the toner of the replenishment amount X is replenished. Then, after the image forming operation is performed at step S6, the process proceeds to step S7.

At step S7, the control part 70 decides whether an absolute value (|X−Y|) of a difference (X−Y) of the replenishment amount X and the predicted consumption Y is equal to or smaller than a threshold value T1.

As a result, when it is decided that the absolute value (|X−Y|) of the difference (X−Y) is equal to or smaller than the threshold value T1, it is judged that an amount of the toner contained in the developer container 30 is within a normal range and an abnormality is not occurred. On the other hand, when it is decided that the absolute value (|X−Y|) of the difference (X−Y) is larger than the threshold value T1, it is judged that an abnormality, such as an excessive or insufficient replenishment of the toner, is occurred, and then the process proceeds to step S8.

At step S8, the display part 75 informs a user of the occurrence of the abnormality. When the abnormality is displayed on the display part 75, a refresh operation in which the developer carried on the developer carrier is once discharged is performed. Alternatively, a maintenance work is performed by the service man.

When the difference (X−Y) is positive (X−Y>0, X>Y), that is, the replenishment amount X is larger than the predicted consumption Y, because an amount of the toner contained in the developer container 30 is excessive, a charging failure of the toner is easily occurred. Alternatively, the replenished toner is easily stayed in the developer container 30 without consumed normally for the toner image formation. Therefore, some problems, such as scattering of the toner in an inside of the image forming apparatus 100 or fogging on the blank part, may be occurred. These problems also occur owing to use of the image forming apparatus 100 in non-regular environment, such as continuous paper printing of a high density image, continuous paper printing of a low density image, leaving the image forming apparatus 100 for a long period, high humidity environment, use of the developer of different destination place, use of the non-regular developer and the others. Alternatively, an insufficient amount of electric charge of the toner causes the problems. On the other hand, when the difference (X−Y) is negative (X−Y<0, X<Y), that is, the predicted consumption Y is larger than the replenishment amount X, a sufficient amount of the toner required for the normal toner image formation is not replenished to the developer container 30.

Then, when the absolute value (|X−Y|) of the difference (X−Y) is equal to or smaller than the threshold value T1 at step S7, the process proceeds to step S9 and it is decided whether the difference (X−Y) is positive or negative.

As a result, when it id decided that the difference (X−Y) is positive (or 0), the process returns to step S2. After that, the value of the replenishment amount X is continuously referred at step S3.

On the other hand, when it is decided that the difference (X−Y) is negative at step S9, the process returns to step S1 and the replenishment of the toner is performed. That is, as described above, when the difference (X−Y) is negative, because a sufficient amount of the toner required for the normal image formation is not replenished, the control part 70 controls so as to replenish the toner. After that, at step S3, the value of the replenishment amount X is obtained by adding the replenishment amount by the replenishment at this time to the replenishment amount by the replenishment at last time.

In this way, by using the replenishment amount (X) and the predicted consumption (Y) during a period from the toner replenishment at last time (the last-time replenishment) to the toner replenishment at this time (the this-time replenishment) by the toner replenishment device 40, it is decided whether the replenished toner is adequately consumed for the image forming operation or not.

As described above, according to the image forming apparatus 100 of the present disclosure, by using the predicted consumption Y calculated from the image data and the replenishment amount X calculated from the rotation speed of the replenishment motor M, an abnormality of the image forming apparatus 100, such as the toner scattering and the image density failure, can be informed. In this way, because it is not required to use an optical sensor, it becomes possible to inform a user of the abnormality immediately and inexpensively. In addition, by deciding whether the difference (X−Y) of the replenishment amount X and the predicted consumption Y is positive or negative, an adequate countermeasure can be taken before a remarkable abnormality is occurred. Accordingly, the occurrence of the abnormality can be prevented previously and a number of information of the abnormality can be decreased.

Figure 7:
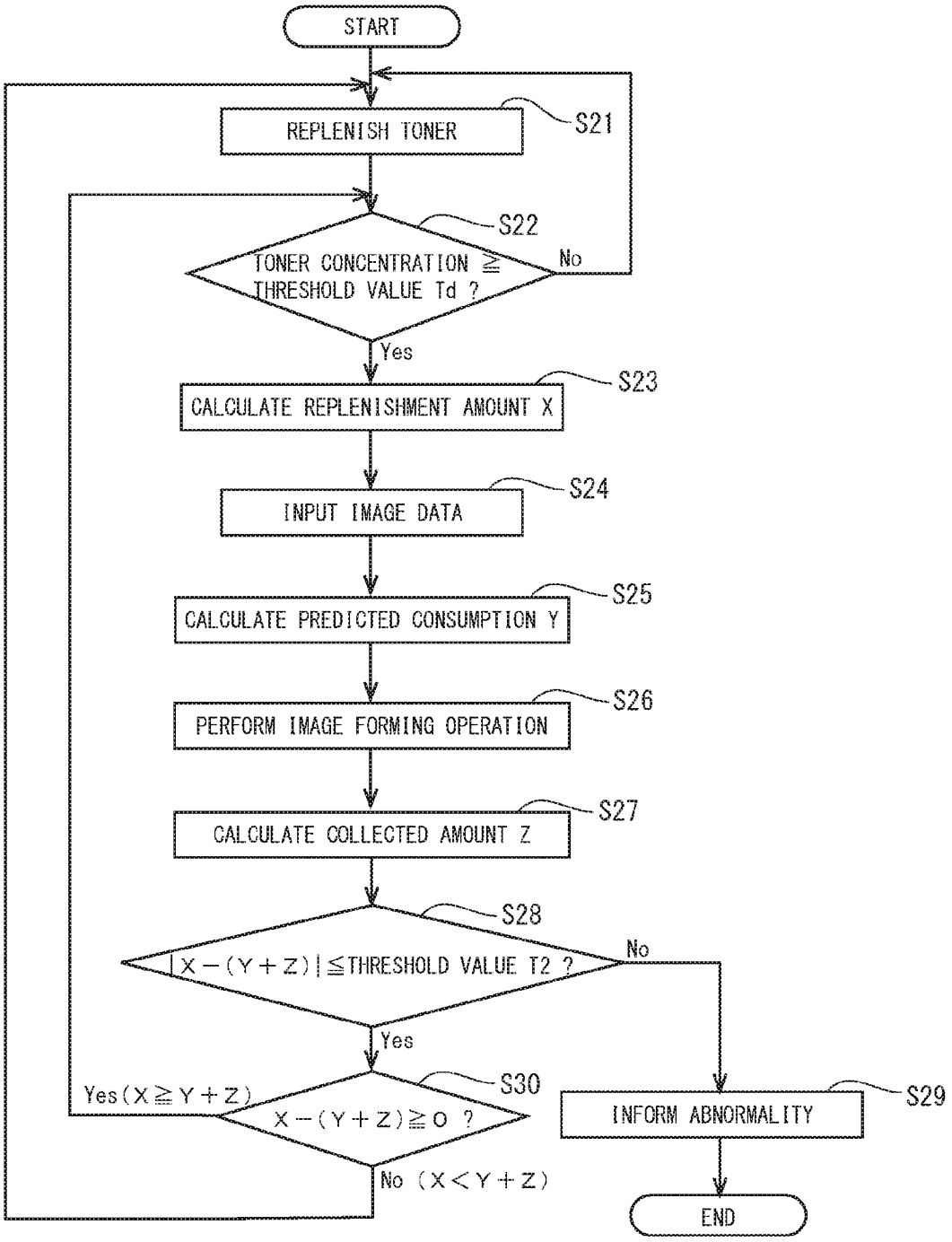
FIG. 7 is a flowchart explaining an abnormality detecting process of a second embodiment, in the image forming apparatus according to the embodiment of the present disclosure.

Next, an abnormality detecting process of a second embodiment will be described with reference to a flowchart showing in FIG. 7. In the abnormality detecting process, by comparing the replenishment amount (X) of the toner replenished by one toner replenishment of the toner replenishment device 40 with a sum of the predicted consumption (Y) of the toner to be consumed by the image forming operation performed after the toner replenishment and the collected amount (Z) of the toner collected by the image forming operation performed after the toner replenishment, it is decided whether the replenished toner is adequately consumed for the normal image formation or not.

First, at step S21, the replenishment motor control part 72 controls the toner replenishment device 40 to replenish the toner to the developer container 30 from the toner container 4*a*.

Next, at step S22, the replenishment motor control part 72 decides whether a toner concentration detected by the toner concentration sensor 38 of the developer container 30 is equal to or larger than the predetermined concentration Td or not.

As a result, when it is decided that the detected toner concentration is equal to or larger than the predetermined concentration Td, the process proceeds to step S23. At step S23, the replenishment amount calculation part 73 calculates an amount X (a replenishment amount) of the replenished toner.

Next, when the image data is input from the image input device at step S24, the predicted consumption calculation part 71 calculates a predicted consumption Y based on the input image data at step S25. Then, after the image forming operation is performed at step S26, the process proceeds to step S27.

At step S27, the collected amount calculation part 74 calculates an amount Z (a collected amount) of the toner collected by the drum cleaning devices 7*a* to 7*d* and the belt cleaning device 19 in the image forming operation, and then the process proceeds to step S28.

At step S28, the control part 70 decides whether an absolute value (|X−(Y+Z)|) of a difference (X−(Y+Z)) of the replenishment amount X and a sum of the predicted consumption Y and the collected amount Z is equal to or smaller than a threshold value T2. The threshold value T2 is smaller than the threshold value T1.

As a result, when it is decided that the absolute value (|X−(Y+Z)|) of the difference (X−(Y+Z)) is equal to or smaller than the threshold value T2, it is judged that an amount of the toner contained in the developer container 30 is within a normal range and an abnormality is not occurred. Then, the process proceeds to step S30. At step S30, the same process as step S9 of the flowchart (refer to FIG. 6) of the first embodiment is performed.

On the other hand, when it is decided that the absolute value (|X−(Y+Z)|) of the difference (X−(Y+Z)) is larger than the threshold value T2, it is judged that an abnormality, such as an excessive or insufficient replenishment of the toner, is occurred, and then the process proceeds to step S29.

At step S29, the display part 75 informs a user of the occurrence of the abnormality. When the abnormality is displayed on the display part 75, a refresh operation in which the developer carried on the developer carrier is once discharged is performed. Alternatively, a maintenance work is performed by the service man.

In the second embodiment, the predicted consumption Y is obtained by accumulating the predicted consumption Y predicted from the image data input after the toner of the replenishment amount X is replenished. The collected toner amount Z is obtained by accumulating the collected toner amount Z collected in the image forming operation performed after the toner of the replenishment amount X is replenished.

According to the second embodiment, because an amount (the collected amount Z) of the toner collected by the drum cleaning devices 7*a* to 7*d* and the belt cleaning device 19 is used as an amount to be consumed necessarily, an amount of the toner consumed actually in the image forming operation can be calculated with a small error. Accordingly, the second embodiment is preferred in view of accurate information of the abnormality.

Figure 8:
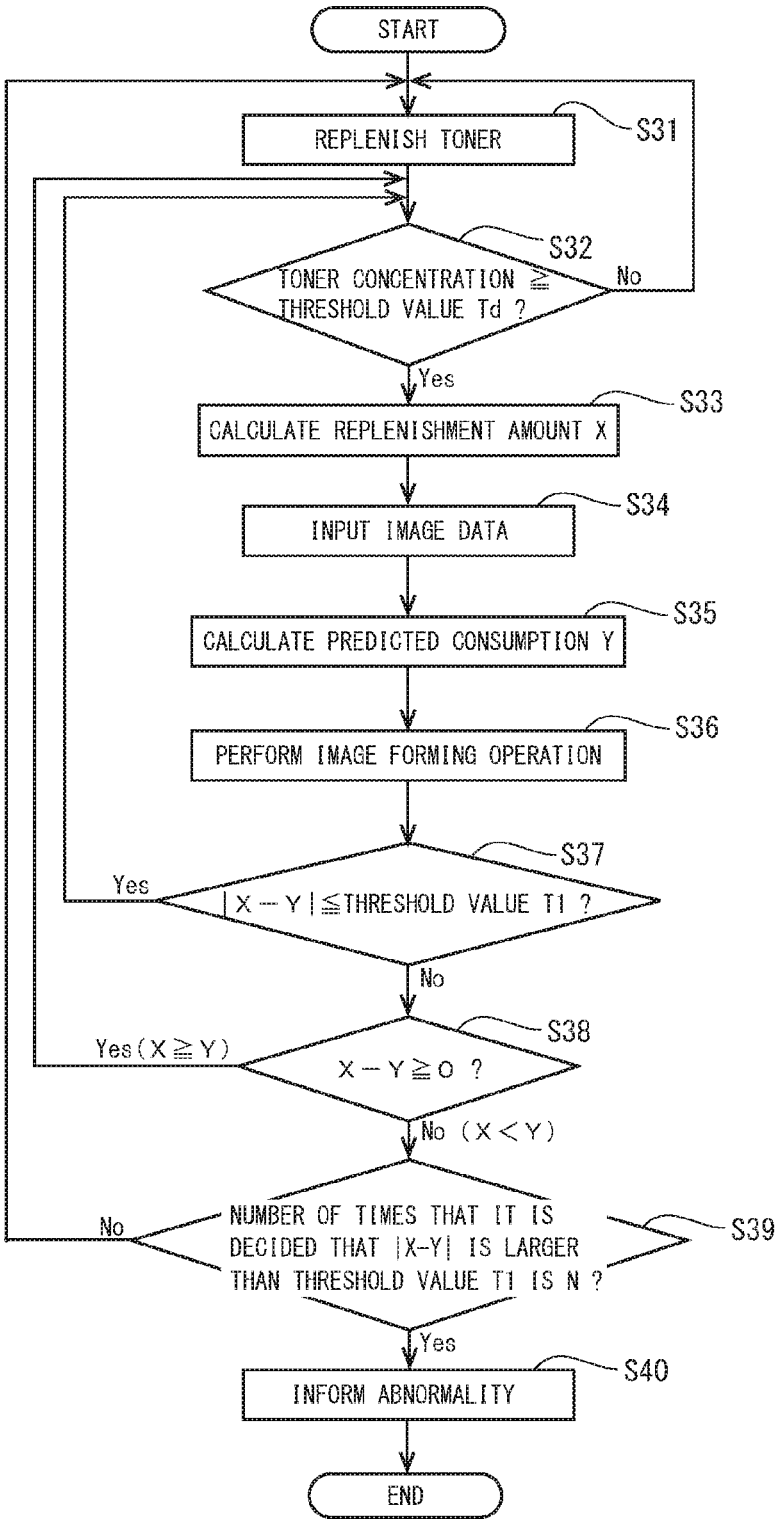
FIG. 8 is a flowchart explaining an abnormality detecting process of a third embodiment, in the image forming apparatus according to the embodiment of the present disclosure.

Next, an abnormality detecting process of a third embodiment will be described with reference to a flowchart showing in FIG. 8.

Steps from step S31 to step S37 are the same as steps from step S1 to step S7 of the first embodiment (refer to FIG. 6), and their explanation is omitted. In the third embodiment, when the absolute value (|X−Y|) of the difference (X−Y) is larger than the threshold value T1 at step S37, the process proceeds to step S38, and it is decided whether the difference (X−Y) is positive or negative.

As a result, when it is decided whether the difference (X−Y) is positive (or 0), the process returns to step S32 in the same way as the first embodiment. On the other hand, when it is decided whether the difference (X−Y) is negative, the process proceeds to step S39.

At step S39, it is decided whether a number of times that it is decided that the absolute value (|X−Y|) of the difference (X−Y) is larger than the threshold value T1 at step S37 is a predetermined number of time N or not. For example, N may be two.

As a result, when it is judged that the number of times is smaller than N, the process returns to step S31, and the replenishment of the toner is performed. On the other hand, it is decided whether the number of times that it is decided that absolute value (|X−Y|) of the difference (X−Y) is larger than the threshold value T1 at step S37 is N, the process proceeds to step S40, and the abnormality is informed in the same way as step S8 of the first embodiment.

In the third embodiment, when it is decided that the absolute value (|X−Y|) of the difference (X−Y) is equal to or smaller than the threshold value T1, a countermeasure is not taken. However, when it is decided that the absolute value (|X−Y|) of the difference (X−Y) is larger than the threshold value T1, a countermeasure for preventing enlarging of the abnormality is immediately taken before the abnormality is informed. Then, the abnormality is informed before the abnormality becomes remarkable. Accordingly, a number of the information of the abnormality can be decreased.

In an preferable example of the above embodiments, the predicted consumption calculation part 71 is configured to divide the image part of the image data into a solid pattern and a line pattern and to make the predicted consumption different for each pattern. A document having a plurality of the solid patterns is a photograph, for example. Because an edge portion of the electrostatic latent image formed on each of the photosensitive drums 1*a* to 1*d* has high electric field, a more amount of the toner is adhered to the edge portion than the other portion. Because the line pattern contains a larger number of the edge portions than the solid pattern, an adhered toner amount per unit area is larger in the line pattern than in the solid pattern. Then, it is set that the line pattern consumes the toner larger than the solid pattern by a predetermined amount. Thereby, it becomes possible to accurately predict the consumption (the predicted consumption Y) from the image data and to accurately inform a user of the abnormality.

In addition, the replenishment amount X may be calculated by measuring a concentration of the magnetic developer in the developer containers 30 of the development devise 3*a* to 3*d* using a magnetic permeability sensor. Furthermore, the collected amount Z may be calculated by using a floating type sensor, instead of the weight sensor 60.

In addition, an optical sensor may be provided so as to detect a density of a blank part of the photosensitive drums 1*a* to 1*d* and the intermediate transferring belt 8. In this case, when the above described abnormality is informed, the optical sensor detects the blank part and then it is decided whether the fogging is occurred on the blank part based on the detection result or not. When it is decided that the fogging is occurred, it is judged that the abnormality is caused by the fogging on the blank part. On the other hand, when it is decided that the fogging is not occurred, it is judged that the abnormality is caused by the toner scattering or the excessive concentration of the toner. By judging the cause of the abnormality as described above, an adequate countermeasure corresponding to the cause can be immediately taken.

In addition, the control part may observe a transition of the difference (X−Y) of the replenishment amount X and the predicted consumption Y, predict a time when the difference (X−Y) reaches the threshold value and then perform the toner refresh operation or the maintenance work by a service man before the difference (X−Y) reaches the threshold value. Furthermore, by considering temperature of the image forming apparatus 100, humidity, printing rate, toner cartridge information, concentration calibration information or the others, more accurate prediction of the abnormality and analyze of the cause of the abnormality can become possible.

The embodiments were described in a case of applying the configuration of the present disclosure to the color printer. On the other hand, in another embodiment, the configuration of the disclosure may be applied to another image forming apparatus, such as a copying machine, a facsimile or a multifunction peripheral, except for the color printer.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a developer container configured to contain a developer;

a development device configured to develop an electrostatic latent image into a toner image using the developer, the electrostatic latent image being formed on an image carrier based on image data;

a developer replenishment device configured to replenish the developer from the developer container to the development device; and a control part configured to obtain a replenishment amount (X) of the developer replenished by the developer replenishment device from a last-time replenishment until a this-time replenishment and a predicted consumption (Y) calculated based on the image data output from the last-time replenishment until the this-time replenishment, and to inform abnormality when an absolute value (|X−Y|) of a difference (X−Y) of the replenishment amount (X) and the predicted consumption (Y) is larger than a threshold value.

2. The image forming apparatus according to claim 1, wherein the control part controls the developer replenishment device so as to replenish the developer to the development device from the developer container when the absolute value (|X−Y|) of the difference (X−Y) of the replenishment amount (X) and the predicted consumption (Y) is equal to or smaller than the threshold value and the difference (X−Y) of the replenishment amount (X) and the predicted consumption (Y) is negative.

3. The image forming apparatus according to claim 2, wherein the control part informs abnormality when a number of times that it is decided that the absolute value (|X−Y|) of the difference (X−Y) of the replenishment amount (X) and the predicted consumption (Y) is larger than the threshold value reaches a predetermined number of time.

4. An image forming apparatus comprising:

a developer container configured to contain a developer;

a development device configured to develop an electrostatic latent image into a toner image using the developer, the electrostatic latent image being formed on an image carrier based on image data;

a developer replenishment device configured to replenish the developer from the developer container to the development device;

a transferring device configured to transfer the toner image developed by the development device to a medium;

a collecting device configured to collect the developer remained on the image carrier after the toner image is transferred to the medium by the transferring device; and a control part configured to obtain a replenishment amount (X) of the developer replenished by the developer replenishment device from a last-time replenishment until a this-time replenishment, a predicted consumption (Y) of the developer, calculated based on the image data output from the last-time replenishment until the this-time replenishment and a collected amount (Z) of the developer collected by the collecting device from the last-time replenishment until the this-time replenishment, and to inform abnormality when an absolute value (|X−(Y+Z)|) of a difference (X−(Y+Z)) of the replenishment amount (X) and a sum (Y+Z) of the predicted consumption (Y) and the collected amount (Z) is equal to or larger than a threshold value.

5. The image forming apparatus according to claim 4, wherein the control part controls the developer replenishment device so as to replenish the developer to the development device from the developer container when the absolute value (|X−(Y+Z)|) of the difference (X−(Y+Z)) of the replenishment amount (X) and the sum (Y+Z) of the predicted consumption (Y) and the collected amount (Z) is equal to or smaller than the threshold value and a difference (X−(Y+Z)) of the replenishment amount (X) and the sum (Y+Z) of the predicted consumption (Y) and the collected amount (Z) is negative.

6. The image forming apparatus according to claim 1, wherein the predicted consumption (Y) is varied for a solid pattern and a line pattern of the image data.

* * * * *